United States Patent [19]

Harper et al.

[11] 4,424,744

[45] Jan. 10, 1984

[54] ADJUSTABLE DRIVE SYSTEM FOR MATCHING SURFACE SPEEDS OF A TRANSFER ROLL AND PLATE ROLL AND METHOD THEREOF

[75] Inventors: James R. Harper, Charlotte; Charles L. O'Klatner, Denver, both of N.C.

[73] Assignee: Harper Corporation of America, Charlotte, N.C.

[21] Appl. No.: 491,996

[22] Filed: May 5, 1983

Related U.S. Application Data

[62] Division of Ser. No. 371,721, Apr. 26, 1982.

[51] Int. Cl.[3] ..... B41F 31/00

[52] U.S. Cl. ..... 101/349

[58] Field of Search ..... 101/329, 330, 248, 348, 101/349, 350–351, 212, 216, 426

[56] References Cited

U.S. PATENT DOCUMENTS

| | | | |
|---|---|---|---|
| 3,765,328 | 10/1973 | Treff et al. | 101/349 |
| 3,817,176 | 6/1974 | Schultz | 101/248 |
| 4,072,104 | 2/1978 | Schaffer | 101/248 |
| 4,210,078 | 1/1980 | Greiner et al. | 101/349 |
| 4,220,084 | 9/1980 | Maclean et al. | 101/248 |
| 4,309,945 | 1/1982 | Marion | 101/248 |

*Primary Examiner*—E. H. Eickholt

*Attorney, Agent, or Firm*—Woodard, Weikart, Emhardt & Naughton

[57] ABSTRACT

A variable speed flexographic printer with means to match surface speeds of an ink transfer roll with the associated plate roll. A tachometer measures the rotational speed of a plate roll providing a variable DC input through means which adjust said input proportional to the diameters of the plate and ink transfer rolls providing a proportional variable DC signal to a variable speed DC motor driving the ink transfer roll. A wiper and metering blade is mounted to a block adjustably movable to and from the ink roll depending upon the diameter thereof.

3 Claims, 8 Drawing Figures

ADJUSTABLE DRIVE SYSTEM FOR MATCHING SURFACE SPEEDS OF A TRANSFER ROLL AND PLATE ROLL AND METHOD THEREOF

This application is a division of application Ser. No. 371,721, filed Apr. 26, 1982.

BACKGROUND OF THE INVENTION

This invention is in the field of drive mechanisms for transfer and plate rolls and more specifically those used in flexographic printing. It is the practice to apply ink to a transfer roll in turn in contact with an adjacent rotating plate roll. The transfer roll includes an outer cylindrical surface having a plurality of cells formed thereon to hold the ink prior to transferring to a printing plate mounted on the plate roll. The outer surface of the transfer roll eventually becomes damaged through use requiring a turning or grinding down of the outside surface reducing the outside diameter of the roll causing the tangential surface speed of the transfer roll to decrease relative to the tangential surface speed of the plate roll. The net result is an ineffective transfer of ink from the tranfer roll to the plate roll due to slippage of one roll relative to the other roll. Thus, it is the practice to replate or build up the outside diameter of the transfer roll and subsequently reform the cells on the new surface formed thereon. This procedure is quite costly and time consuming in view of the time required to remove the large transfer rolls, transport the rolls to a repair facility where the recoating and regrinding is accomplished.

Effective transfer of ink or other flowable materials is accomplished between the transfer roll and plate roll when the tangential surface speeds are matched along the area of contact between the two rolls. Thus, as the ink transfer roll diameter decreases through either wear or by the regrinding step, the rotational speed of the transfer roll may be increased to match the tangential surface speed of the plate roll. Disclosed herein is an apparatus and method for matching the tangential surface speeds between the adjacent rolls eliminating the prior need for re-plating or metalizing the worn transfer roll.

It is the practice to use a blade biased against the transfer roll to remove excess ink therefrom prior to the transfer roll contacting the plate roll. As the transfer roll is decreased in diameter, the ink wiper blade will eventually not contact the transfer roll. In order to effectively use the means disclosed herein for increasing the speed of the transfer roll, the wiper blade has been mounted on an adjustable bracket allowing the operator to move the wiper blade inwardly towards the transfer roll alleviating the necessity for unmounting and remounting of the wiper blade.

SUMMARY OF THE INVENTION

One embodiment of the present invention is a device for applying a flowable material onto a sheet comprising frame means, a first roll of a fixed diameter rotatably mounted to the frame means, a second roll rotatably mounted to the frame means and contacting along an area of contact the first roll, the second roll having an outside surface holding a flowable material thereon transferable to the first roll upon joint rotation thereof, the surface being of a material to allow reformation to delete any damaged areas reducing the outside diameter of the second roll to a measurable diameter, first drive means associated with the first roll and operable to drivingly rotate the first roll over a range from a low speed to a high speed, counting means associated with the first roll operable to measure rotational speed of the first roll over the range and to produce a counting signal proportional thereto, control means connected to the counting means receiving the counting signal and operable to allow manual adjustment thereof producing an adjusted signal proportional to the counting signal over the range, and, second drive means engaged with the second roll and the control means to receive the adjusted signal and drivingly rotate the second roll as a function thereof allowing the tangential surface speed of the second roll to match along the area of contact the tangential surface speed of the first roll over the range.

A further embodiment of the present invention is a method of flexographic printing comprising the steps of rotating an impression roll and an adjacent plate roll over a range from a low speed to a high speed, contacting an ink roll with the plate roll to transfer ink therebetween, measuring the rotational speed of the plate roll over the range and providing an output signal proportional thereto, rotating the ink roll as a function of the output signal and proportional to the rotation of the plate roll as the radius of the plate roll is to the radius of the ink roll.

It is an object of the present invention to provide a new and improved device for applying a flowable material such as ink onto a sheet.

A further object of the present invention is to provide a new and improved method of flexographic printing.

Yet another object of the present invention is to provide means for adjustably moving a wiper blade toward an ink transfer roller.

Related objects and advantages of the present invention will be apparent from the following description.

DESCRIPTION OF THE PREFERRED EMBODIMENTS

Figure 1:
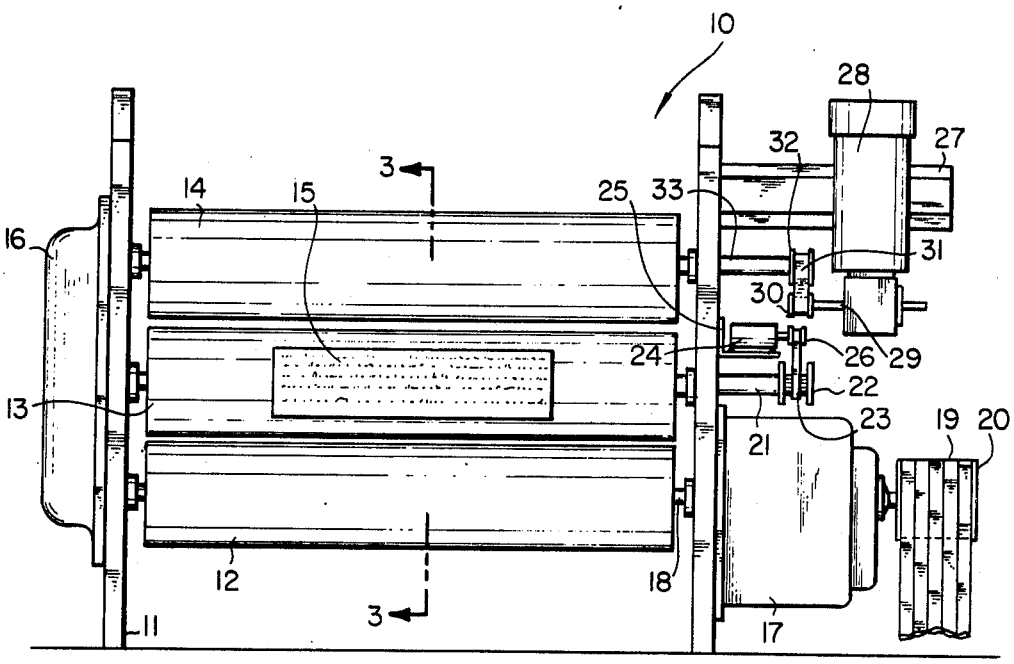
FIG. 1 is a front view of a flexographic printer incorporating the present invention.
Figure 2:
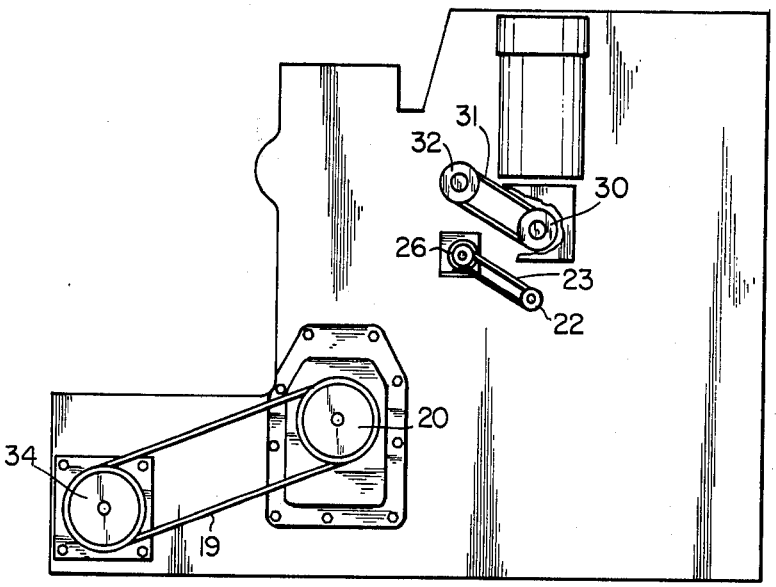
FIG. 2 is a right hand end view of the printer of FIG. 1.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a flexographic printer 10 including a frame 11 having a pair of vertical side walls bearingly receiving and supporting three adjacent rolls 12, 13 and 14. Roll 12 is rotatably mounted to frame 11 and is connected and driven by a variable speed motor 34 (FIG. 4) in turn powering continuous belts 19 frictionally engaged upon spool 20 mounted to the axle 18 supporting roll 12. Axle 18 extends through gear housing 17 with the outer end of the axle having spool 20 mounted thereon.

Figure 3:
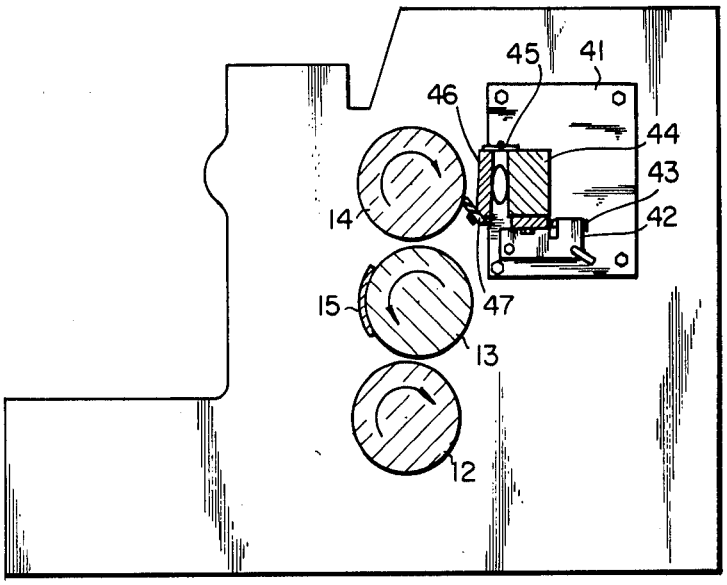
FIG. 3 is a cross-sectional view taken along the line 3—3 of FIG. 1 and viewed in the direction of the arrows.
Figure 4:
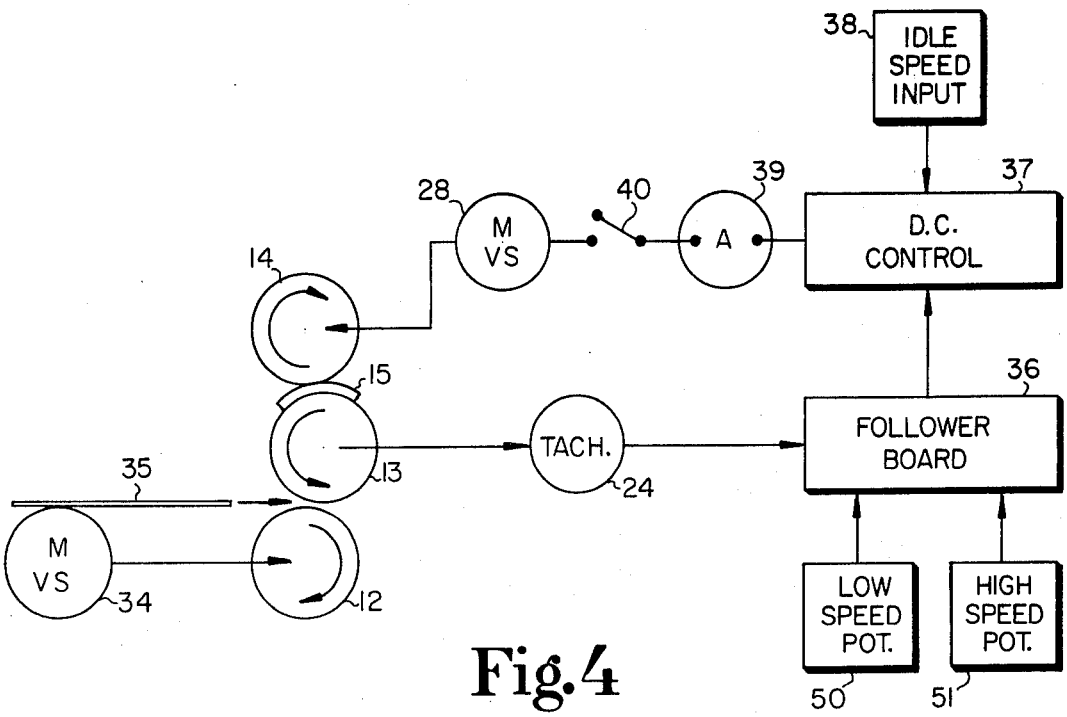
FIG. 4 is a schematic diagram illustrating the drive mechanism for the printer of FIG. 1.

A second roll or plate cylinder 13 is rotatably mounted to frame 11 and has mounted thereon a printing plate 15 with the required indicia to print upon board 35 (FIG. 4) which is passed between the cylindrical impression roll 12 and the plate cylinder 13. Conventional gearing is provided within housing 16 (FIG. 1) to connect axle 18 to axle 21 upon which roll 13 is mounted. Thus, roll 12 is drivingly rotated in a clockwise direction as shown in FIG. 4 with roll 13 in turn being driven by axle 18 in a counterclockwise direction. The third roll or ink transfer roll 14 is rotatably mounted to frame 11 by axle 33 and is rotated by DC motor 28 in a clockwise direction or in a direction opposite of the rotation of roll 13 (FIG. 4). Roll 14 is spaced from roll 13 to contact plate 15 mounted to roll 13 and to transfer ink from the transfer roll 14 directly onto the printing plate 15. Transfer roll 14 is rotated past the ink distribution system applying and metering ink via blade 47 (FIG. 3) mounted to plate 46 hingedly connected by hinge 45 to block 44. Block 44 in turn is mounted to plates 41 attached to the opposite vertical side walls of frame 11. Such an ink distribution and metering system is described and disclosed in U.S. Patent application Ser. No. 266,890, filed May 26, 1981 and entitled Flexographic Ink Distribution System which is hereby incorporated by reference. Plate 15 is spaced a sufficient distance from transfer roll 14 to contact the transfer roll once per revolution of the plate cylinder 13.

Roll 14 is commercially available in the industry and is known as an anilox roll. The outer metal surface of the roll includes a plurality of cells designed to hold ink on the surface of the roll. Continued use of the roll results in the outside surface wearing and becoming damaged by dents, mars, etc., requiring the roll to be ground down to a smooth cylindrical suface prior to formation of the ink cells on the surface. The tangential surface speed of roll 14 is decreased relative to the tangential surface speed of roll 13 along the area of contact with plate 15. The surface speed of a cylinder is defined by the formula SS=rpm's (2 pi r where SS stands for the surface speed, rpm stands for revolution per minute of the cylinder and r stands for the radius of the cylinder). The surface speed of roll 13 is defined by the same formula only r=the radius of roll 13 plus the thickness of plate 15. With a decreasing radius of roll 14, the desired rotational speed of roll 14 is defined by the formula $rpm_{14}=rpm_{13}(r_{13}+t_{15})/r_{14}$ where $t_{15}$ equals the thickness of plate 15. Since the radius of roll 13 and the thickness of plate 15 is known and constant and since the radius of roll 14 can be determined and the rotational speed of roll 13 may be measured by a tachometer, the desired rpm for roll 14 may be easily determined and adjusted thereby matching the surface speeds.

Printer 10 includes a tachometer 24 mounted to a right angle bracket 25 secured to the vertical side wall of frame 11. Axle 21 has a spool 22 connected thereto in turn engaged by a continuous belt 23 extending around spool 26 mounted to the drive shaft of tachometer 24. The tachometer is used to measure the rpm's of roll 13 and provides through conventional circuitry a varying DC signal to drive DC motor 28 mounted by bracket 27 to frame 11. The output drive shaft 29 of motor 28 has spool 30 mounted thereon in turn engaged by continuous belt 31 extending around sprocket 32 fixedly mounted to axle 33 of roll 14. By measuring the diameter of roll 14 and measuring the rotational speed of roll 13 by tachometer 24, adjustments may be made to suitably drive motor 28 rotating roll 14 to match its tangential surface speed with the tangential surface speed of roll 13. The system described herein is able to match tangential surface speeds of rolls 13 and 14 even when roll 14 decreases in diameter by ½ inch or more.

Tachometer 24 is connected to follower board 36 (FIG. 4) and provides a varying DC voltage input to the follower board from between 0 to 50 volts DC depending upon the rotational speed of roll 13. Follower board 36 is commercially available with one such follower board being manufactured by Minarik Electric, Los Angeles, Calif. under model designation number PCM2. Such a follower board is used as commercially available with the exception that a 200 Ohm resistor is placed on the input line to the follower board connected to tachometer 24 to adapt board 36 to the particular tachometer utilized. Board 36 in turn provides a 0 to 10 volt DC signal to DC control 37 in turn connected to a DC variable speed motor 28 in turn rotatingly driving roll 14.

The DC drive control 37 contains all the necessary circuitry to perform the primary control functions requied to control the speed of, or current supplied to, small horsepower DC motors (shunt wound or permanent magnet). Maximum versatility has been designed into the drives by the use of jumper programming. Such functions as input voltage selection (230/115 VAC), armature voltage selection (High—180 VDC, Low—90 VDC), motor current range (High, Medium and Low), and speed/current regulation are achieved by selection of the jumper positions. DC control 37 is commercially available from Wer Industrial, Division of Emerson Electric, 3036 Alt Boulevard, Grand Island, N.Y. 14072 under model designation Focus I-2400.

Figure 5:
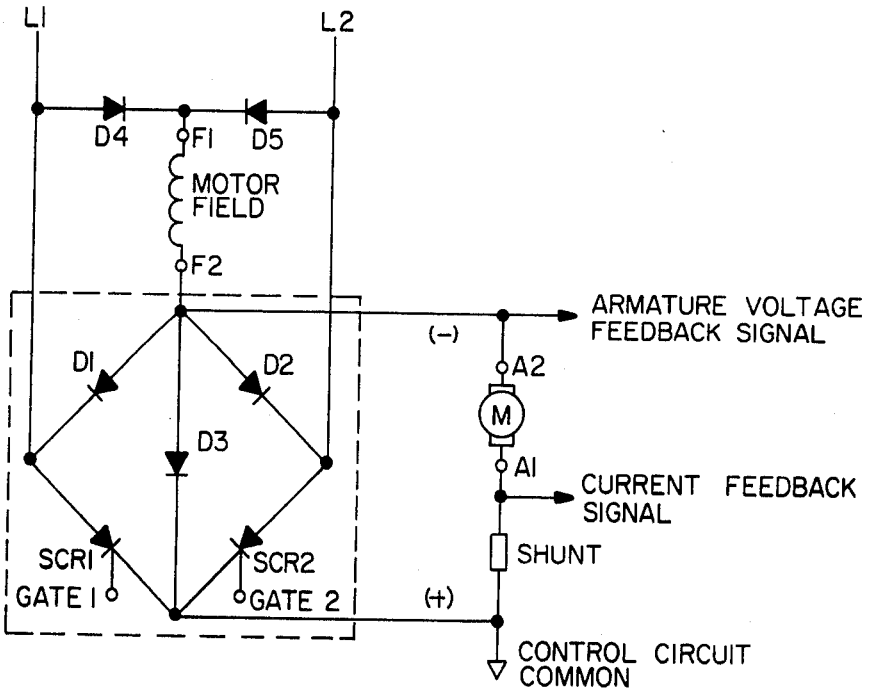
FIG. 5 is a schematic diagram of the DC control power bridge assembly.

The power bridge (FIG. 5) is an encapsulated SCR power cube consisting of two SCR's and three diodes. Basic operation is as follows: when L1 is more positive with respect to L2, SCR1 is gated "on" at a particular phase angle commanded by the drive regulator circuitry. Current will then flow from L1, though SCR1, the shunt resistor, the drive motor, diode D2, and back to L2. When L2 is more positive with respect to L1, SCR2 is gated "on" and current will flow from L2, through SCR2, the shunt resistor, the drive motor, and back to L1 through diode D1. This action results in a positive flow of current through the motor. Diode D3 is known as a "free wheeling" diode whose purpose is to insure continuity of the load current when the previously "fired" SCR becomes reverse biased. This diode also helps the SCR to return to its blocking state. Three points of interest can be found on the diagram (FIG. 5). The first of which is armature voltage feedback signal. This signal is used by the drive to determine when the drive is at the correct operating speed (voltage) as requested by the operator's speed potentiometer. The second of the signals is the current feedback signal. This signal provides current information to the drive's inner current loop. The third point of interest is the location of control circuit common which is tied to the positive terminal of the power bridge. It should therefore be noted that the control circuit common is "floating" and should never be tied to earth common. Otherwise, a catastrophic destruction of the drive will occur.

Also shown in FIG. 5 is the motor shunt field supply. Diodes D1, D2, D4, and D5 form a single phase full wave uncontrolled rectifier bridge. This bridge will produce a 200 VDC field voltage when operated at 230 VAC and 100 VDC field voltage when operated at 115 VAC. The motor shunt field supply is rated at 3 amps.

Figure 6:
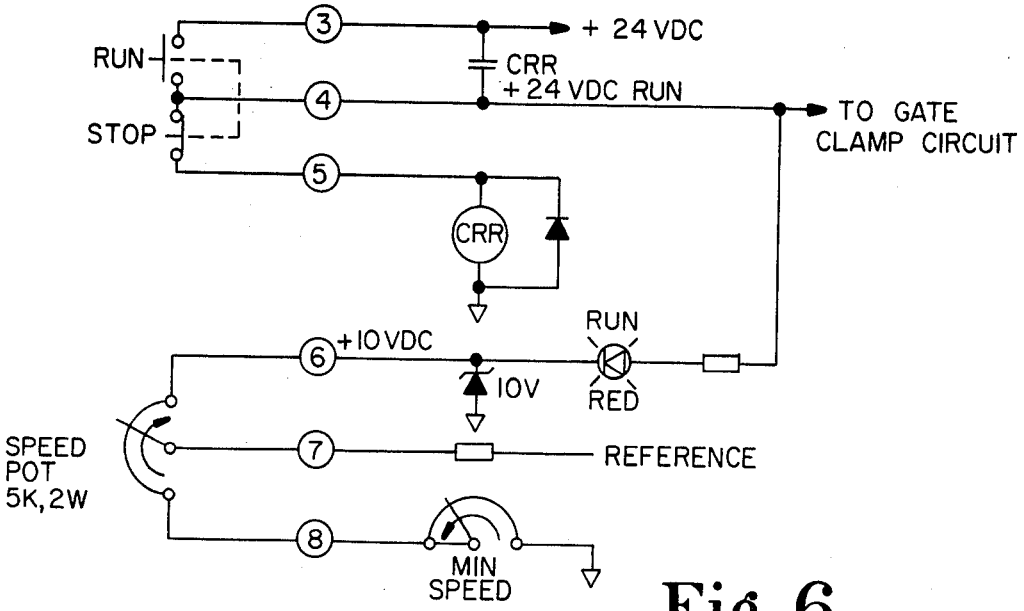
FIG. 6 is a schematic diagram of the DC control run/stop logic (enclosed control).
Figure 7:
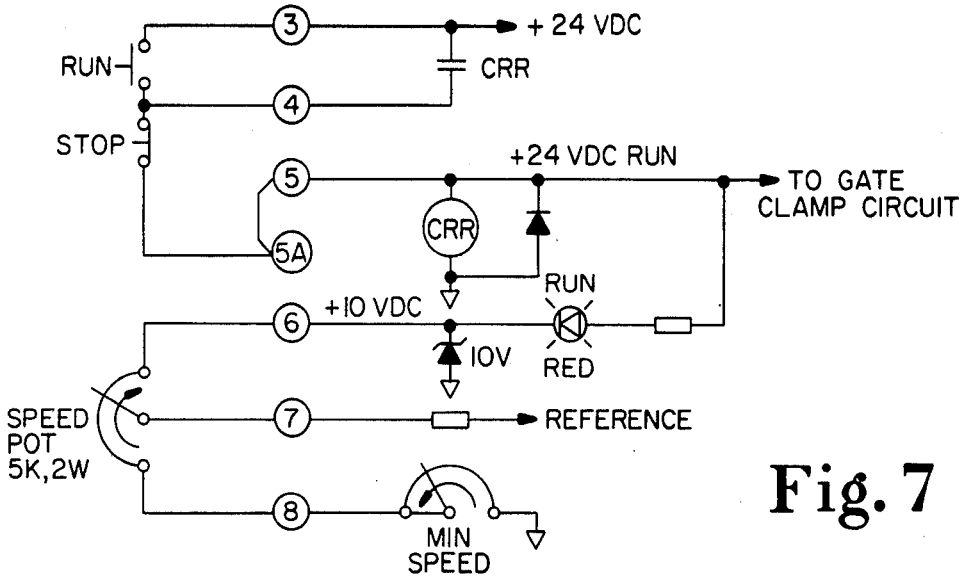
FIG. 7 is a schematic diagram of the DC control run/stop logic (chassis control).

The standard run/stop logic can be found in FIGS. 6 and 7. Operation is as follows. When the run button is momentarily depressed, 24 volts DC is supplied to CRR (Control Run Relay). This will then pick-up relay CRR. When RELAY CRR picks up, a normally open contact will close and thus seal in the run relay (CRR). 24 VDC will then be present on Terminal #4 and #5 and is directed to two places. The first is the speed potentiometer voltage supply causing the run LED to light and 10 volt reference to appear at Terminal #6 (top of speed potentiometer). The voltage is zener regulated and provides protection to the 24 volt supply in the event of Terminal #6 being shorted to common. The second place in which the voltage is directed is a transistor clamp circuit releasing the gate drives whenever the drive is placed in the run mode. The circuit provides three important functions: (1) it prevents misfiring of the SCR's when power is first applied to the drive, (2) it provides positive gate pulse suppression in the stop mode, and (3) it resets the inner current loop upon drive stop.

Figure 8:
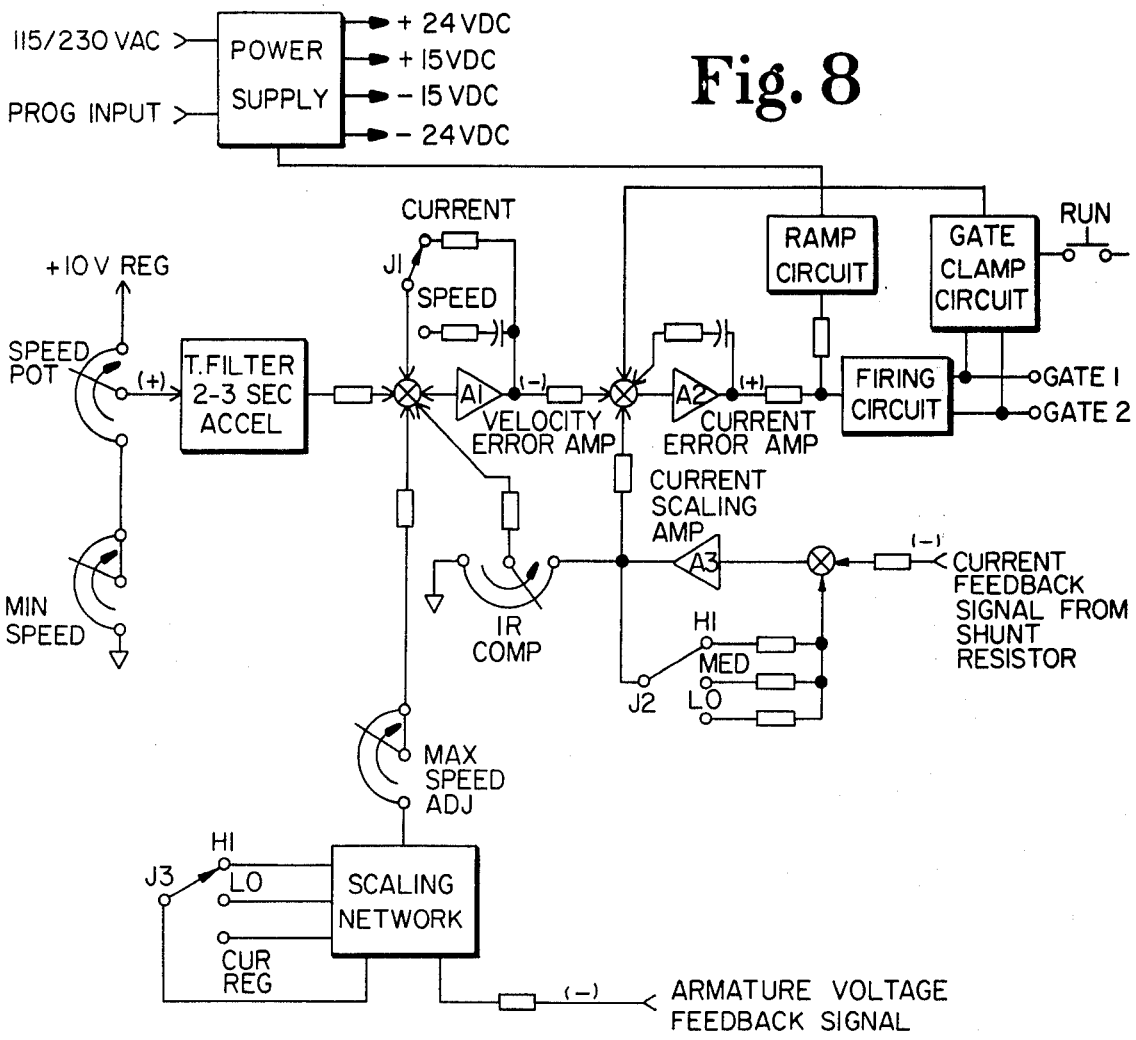
FIG. 8 is a block diagram of the DC control circuit.

The regulator circuitry (FIG. 8) is of the multiloop type, consisting of an inner current loop and an outer voltage ("Speed") loop. The current error amplifier is a proportional plus integral controller having an integrating time constant of approximately 10 msec. The amplifier receives a negative voltage (current reference) from the outer loop velocity error amplifier and a positive current feedback voltage. The positive feedback voltage is derived from the curret scaling amplifier which is of the inverting type having an adjustable gain allowing the operator to adapt the maximum current level of the drive to his motor. There is one other input to the inner current loop which is only present in the stop mode and its purpose is to reset the current error amplifier. The output of the current error amplifier is a positive voltage with an amplitude such that when fed to the firing circuit it will produce gate pulses at a phase angle producing the armature current requested by the velocity error amplifier.

The velocity error amplifier is also a proportional integral controller. Its integrating time constant is approximately 2.2 seconds. There are three inputs into this amplifier. The first of these is the speed command. The command is the voltage at the wiper of the operator speed potentiometer passed through a T-filter which provides a 2-3 second acceleration time. The second input is the armature voltage feedback. The feedback level is adjustable to allow the operator to set the maximum motor speed to his application requirement. The feedback level is also scaled by jumper programming for a 180 VDC motor (230 VAC input), 90 VDC motor (115 VAC input) and is shorted out when the drive is used as a current regulator. The third input to this amplifier is the IR compensation input used to compensate for the IR losses in the motor. It should also be noted the amplifier can be changed (by jumper programming) to have approximately a gain of one, when the drive is to be used as a current regulator.

The firing circuit consists of three parts: (1) a timing ramp circuit, (2) a comparator circuit, and (3) a grated 555 oscillator. The timing ramp is produced by allowing a capacitor to charge to 10 volts in 8.3 msec. This capacitor is reset to zero volts at every line zero crossing. The ramp voltage is then compared to the output voltage of the current error amplifier. When the ramp voltage exceeds the current error voltage, the comparator then toggles to +15 volts. The 15 volt signal enables the 555 oscillator, which will produce a "train" of firing pulses to the SCR's approximately 40 μSec wide and 800 μSec apart.

DC control 37 provides a varying DC voltage from 0 to 180 volts DC depending upon the varying DC voltage provided by tachometer 24 to follower board 36. Meter 39 and switch 40 are provided between DC control 37 and motor 28 to provide an indication of the current and an on/off switch for the operator's control. Follower board 36 includes thereon a low speed potentiometer 50 and high speed potentiometer 51 to allow the operator to set the desired DC output signal from follower board 36 upon receipt respectively of the tachometer reading associated with a low speed and high speed of roll 13 to achieve the desired corresponding low speed and high speed of roll 14. In other words, roll 13 is driven at a selected low speed, the rotational speed of roll 14 is then calculated depending upon the radius of roll 14 and the rotational speed of roll 13 with low speed pot 50 then being adjusted until the calculated rotational speed of roll 14 is achieved. Likewise, roll 13 is then driven at a selected high speed, the corresponding high speed for roll 14 is then calculated and potentiometer 51 is adjusted until the calculated rotational high speed of roll 14 is achieved. The circuitry of board 36 and control 37 is such that a linear relationship exists between the low speed output and high speed output provided to motor 28. Once potentiometers 50 and 51 are properly set, the rotational speed of roll 14 and therefore roll 13 may be manually adjusted between the preselected low and high rotational speeds with motor 28 thereby driving roll 14 at the corresponding speed to match the tangential surface speed of rolls 13 and 14. Different printing speeds are therefore available. Due to the linear relationship provided by the outputs of board 36 and control 37, the output provided by DC control is directly proportional to the diameters or radii of rolls 13 and 14.

It is desirable to stop roll 13 for a variety of reasons; however, it is necessary to continue the rotation of roll 14 to ensure the continued flow thereafter of ink. Thus an idle speed input 38 is provided into DC control 37 to provide a minimum DC output from control 37 to motor 28 driving roll 14 at a low speed whenever a zero DC input to follower board 36 is provided by tachometer 24.

Metering blade 47 along with mounting block 44 are mounted atop adjustment block 42 (FIG. 3) in turn bolted to plate 41 attached to the vertical side walls of frame 11. An adjustment bolt 43 is threadedly mounted to block 42 having a distal end abuttingly engaging block 44 and operable to move block 44 toward or away from roll 14 depending upon the diameter of roll 14 and the amount of pressure to be applied by the metering blade to the transfer roll.

The system disclosed herein is particularly advantageous to allow different printing speeds. The particular printing speed selected will determine the speed of rotation of rolls 12 and 13 with the rotation of roll 14 being automatically provided by the tachometer and DC control circuit. The commercially available DC control 37 and follower board 36 includes a number of built in features including automatic compensation for changes in the source of electrical current as well as automatically providing additional current to motor 28 in the event additional load is applied to the motor by the bearing supporting roll 14 or by blade 47 being moved against the roll. The system allows for the previously described manual adjustment due to the change in diameter of roll 14 and for the automatic increase or decrease of the rotational speed of roll 14 as the speed of rotation provided by motor 34 is manually changed. Further, when the press is temporarily stopped by halting rotation of roll 13, roll 14 will continue to rotate at an idle speed.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

While the invention has been described for applying ink, it is to be understood that other flowable material, such as adhesive may be applied by the device disclosed herein.

The invention claimed is:

1. A method of flexographic printing comprising the steps of:

rotating an impression roll and an adjacent plate roll over a range from a low speed to a high speed;

contacting an ink roll with said plate roll to transfer ink therebetween;

measuring the rotational speed of said plate roll over said range and providing an output signal proportional thereto;

rotating said ink roll as a function of said output signal and proportional to the rotation of said plate roll as the radius of said plate roll is to the radius of said ink roll.

2. The method of claim 1 and further comprising:

periodically adjusting said output signal upon diameter reduction of said ink roll to match tangential surface speeds between said ink roll and said plate roll.

3. The method of claim 2 and comprising the further step of adjustably and manually moving a wiper metering blade toward said ink roll as the diameter thereof decreases.

* * * * *